US005939169A

United States Patent [19]

Bondoc et al.

[11] Patent Number: 5,939,169

[45] Date of Patent: Aug. 17, 1999

[54] COMPOSITE ROOFING AND SIDING SHINGLE

[75] Inventors: Alfredo A. Bondoc, Somerset; William R. Carroll, Sussex; Frederick W. Sieling, Bound Brook, all of N.J.

[73] Assignee: Building Materials Corporation of America, Wayne, N.J.

[21] Appl. No.: 08/786,950

[22] Filed: Jan. 23, 1997

[51] Int. Cl.[6] ..... E04D 1/00

[52] U.S. Cl. ..... 428/141; 428/47; 428/77

[58] Field of Search ..... 428/77, 47, 48, 428/49, 141

[56] References Cited

U.S. PATENT DOCUMENTS

| | | | |
|---|---|---|---|
| D. 314,628 | 2/1991 | Jenkins et al. | D25/139 |
| D. 326,330 | 5/1992 | Klein | D25/139 |
| D. 350,615 | 9/1994 | Klein et al. | D25/139 |
| D. 366,124 | 1/1996 | Hannah et al. | D25/139 |
| 1,894,615 | 1/1933 | Wettlaufer | 52/553 |
| 3,624,975 | 12/1971 | Morgan et al. | 52/DIG. 16 |
| 5,181,361 | 1/1993 | Hannah et al. | 52/535 |
| 5,195,290 | 3/1993 | Hulett | 52/DIG. 16 |
| 5,426,902 | 6/1995 | Stahl et al. | 52/314 |

*Primary Examiner*—Henry F. Epstein
*Attorney, Agent, or Firm*—Marilyn J. Maue; William J. Davis

[57] ABSTRACT

This invention relates to a composite shingle which includes (a) a rectangular shingle sheet having an undivided headlap portion and a lower butt portion which is divided into spaced apart tabs and (b) an elongated backup strip of hue or color contrasting with said shingle sheet, positioned under the tabs of said butt portion and secured to the lower portion of the headlap, the bottom edge of said strip conforming in outline to the bottom edge of said tabs and extending below said tabs at a distance equal to the spaces between the tabs, so as to form a uniform border around tabs.

19 Claims, 10 Drawing Sheets

COMPOSITE ROOFING AND SIDING SHINGLE

BACKGROUND OF THE INVENTION

Building material shingles comprising a fiberglass mat, organic or inorganic felt or fabric stock impregnated with asphalt and surface covered with weather resistant mineral granules are well known. For the most part these shingles have been offered as relatively inexpensive alternatives to more costly tile, slate and wood shakes. Very little attention has been directed to development of a shingle which does not imitate tile, slate or shake counterparts but which is aesthetically pleasing in its own right when installed on a roof or siding surface. It is desirable that such shingles retain the strength, fire resistance and weatherability of current shingles while creating a distinctive, attractive appearance. Accordingly, it is an object of this invention to provide such a unique shingle which can be commercially and economically manufactured using standard equipment.

THE INVENTION

In accordance with the present invention there is provided a composite shingle which includes (a) a shingle sheet having an upper undivided headlap portion and a lower butt portion divided into uniformly spaced apart tabs and (b) an elongated backup strip secured to the lower portion of said headlap whose leading and rear edges are coextensive with those of the headlap and whose width is greater than that of the butt portion and narrower than that of the shingle sheet, said strip deployed under said tabs and having a bottom edge which conforms in outline to the shape of the tab ends and extending below said tabs by a margin equal to the spaces between the tabs.

Generally, the shingle sheet has a length of from about 24 to about 48 inches and a width of from about 10 to about 22 inches; preferably a length of from about 36 to about 40 inches and a width of from about 12 to about 17 inches. The tabs in the butt portion have a vertical extention from the headlap of from 4 to 10 inches; more desirably 5 to 7.5 inches. The breadth of each tab can be varied between about 3 and about 12 inches; more desirably between about 4 and about 8 inches.

The butt portion of instant composite shingle contains 3 to 10 tabs which are uniformly spaced apart between about 0.25 and about 2.00 inches; preferably between about 0.5 and about 1.00 inches. The individual tabs of the present composite shingles can be similar or dissimilar in shape and/or breadth and/or extention as shown in the accompanying drawings. Further, the bottom edges of the tabs can be curved or straight and the tab corners can be crimped or can be formed by right, obtuse or acute angles also as illustrated herein.

The backup strip which underlays the tabs of the composite shingle is of a distinguishable hue or color and is secured to the lower portion of the headlap by conventional means which includes nailing and adhesive attachment. Adhesive can also be applied under the tabs for more secure anchoring between the tabs and the strip in areas subject to high wind velocity or other weathering conditions. Generally, the width of the backup strip is 0.5 to 2.5 inches greater, preferably 1–2 inches greater, than that of the butt portion plus the width of the spacing between tabs and the butt portion has a width equal to or 1.25 to 4 inches less than the width of the headlap. Usually, the butt portion is narrower than the headlap. In the present invention it is critical to the unique appearance herein described that the lower edge of the backup strip duplicates the lower edge of the tabs with which it is associated so as to provide a uniform border around the tab ends and sides.

In a more preferred embodiment of the invention, the first and last tab in the butt portion of the shingle sheet is indented from the respective leading and trailing edge of the headlap portion by a distance of ½ the space between the tabs so that, when the shingle sheets are installed in series and the trailing edge of one shingle abuts the leading edge of the next shingle, the uniform spacing between the tabs is maintained. However, it is to be understood that an embodiment wherein the side edges of the first and last tabs extend flush with the leading and rear edge of the headlap is also within the scope of this invention. In the more preferred embodiment, the tabs are of equal height and are shaped by crimped and right angled corners wherein the backup strip, of a substantially darker hue or color, forms a uniform border or frame around the side and bottom edges of each tab when the shingle sheets are installed in series.

The present shingles are installed in overlapping courses, where the tabs of one shingle cover the headlap portion of the preceding shingle and the tabs of one course are offset from those of the preceding course. The top surfaces of the shingle sheet and the backup strip carry weather resistant granules at least in their exposed areas. Upon installation of courses, the rear edge of one shingle sheet is positioned in abutment with the leading edge of the successive shingle sheet so that the backup strip forms a uniform margin around each tab, thus providing the unique and pleasingly geometric margin which characterizes this invention.

Having generally described the invention, reference is now had to the drawings which illustrate preferred embodiments but which are not to be construed as limiting to the scope of the present invention as defined by the appended claims.

BRIEF DESCRIPTION OF THE DRAWINGS

FIG. 1C shows the assembled shingle of this embodiment. The underside of this embodiment is shown in plan view by FIG. 2 and a sectional plan view of this embodiment when mounted in courses on a roof is shown in FIG. 3, FIGS. 3A, 3B, 3C and 3D are similar top plan views of the above embodiment where shingle sheet (3A) is a darker hue than backup strip (3B).

FIG. 10 is a side view of the present composite shingles.

The following figures are shown in top plan view.

FIG. 1 is a first embodiment of the present composite shingle wherein 1A is non-assembled shingle sheet 2 having tabs 3 with crimped and right angled corners 4 and 5. FIG. 1B is the unattached backup strip 6 which is associated with shingle sheet 2, whose bottom edge conforms with the bottom edges of tabs 3. FIG. 1C is an exposable surface view of assembled sheet 2 attached to backup strip 6.

Figure 1C:
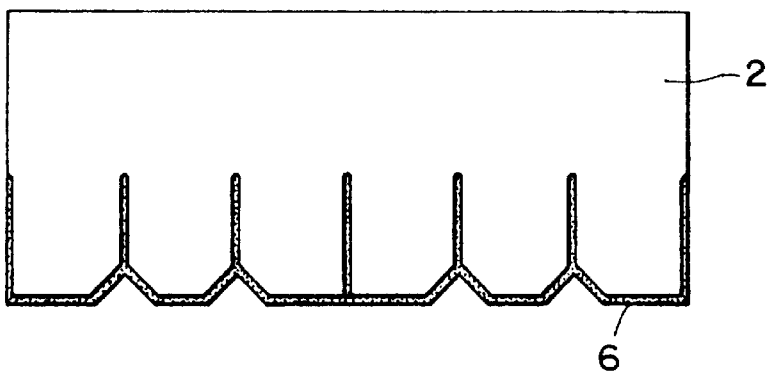
FIGS. 1A, 1B and 1C are top plan views of one embodiment of the present composite shingle wherein the individual parts are shown as shingle sheet (1A) and backup strip of a contrasting hue (1B).
Figure 1O:
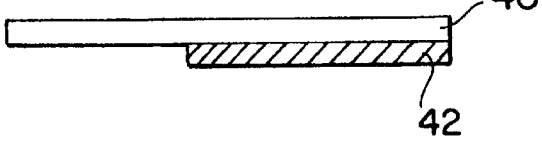
Figure 1A:
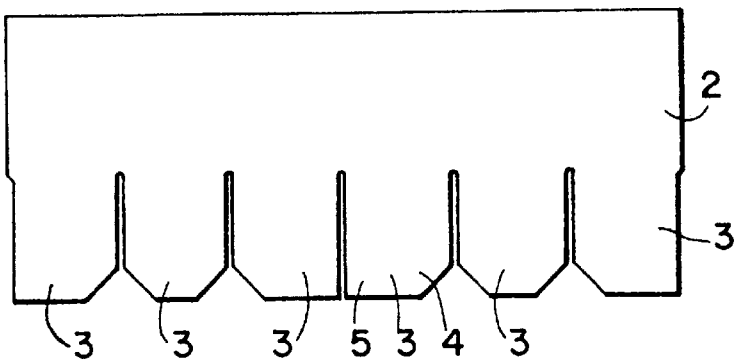
Figure 1B:
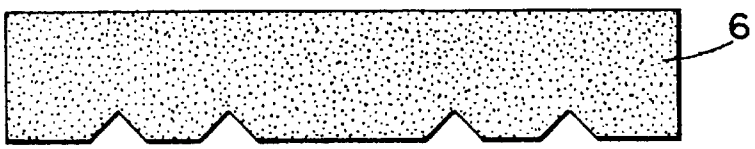
Figure 2:
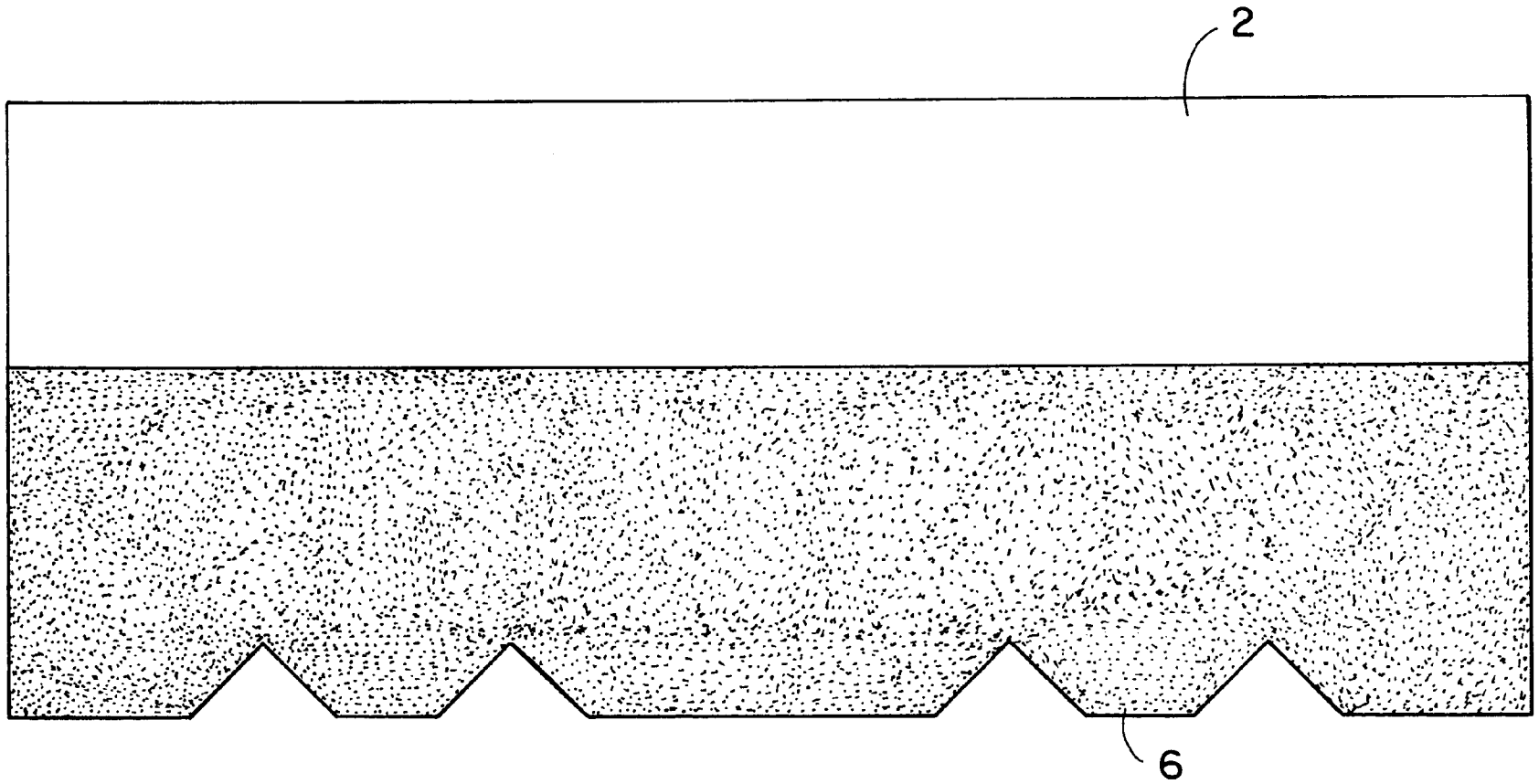

FIG. 2 illustrates the undersurface of FIG. 1C.

Figure 3:
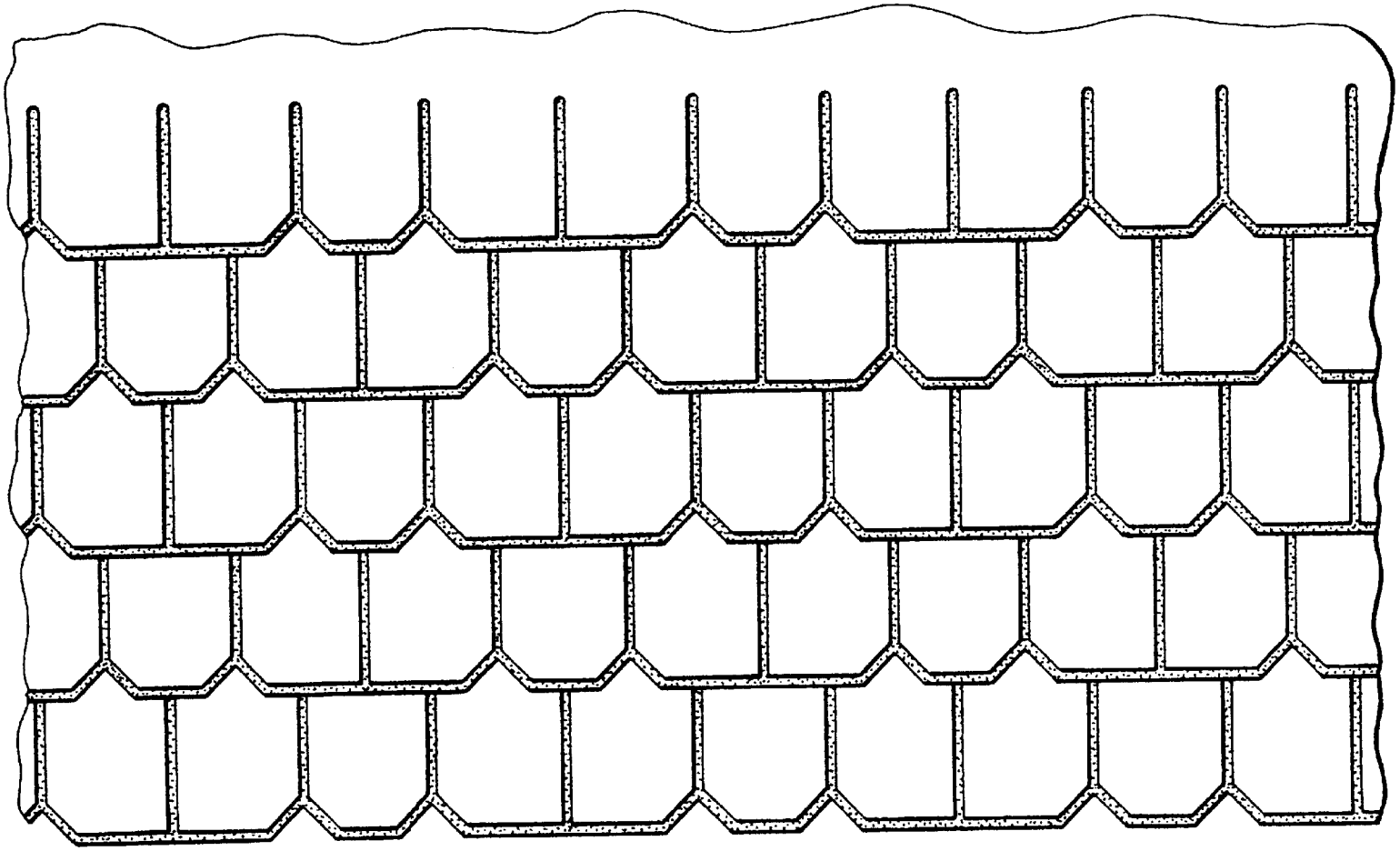
Figure 3A:
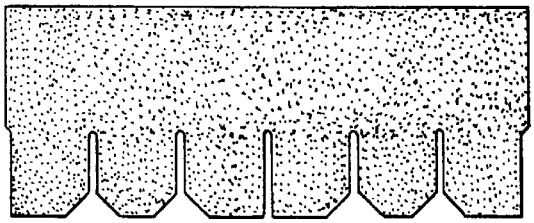
Figure 3B:
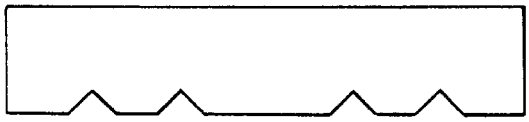
Figure 3C:
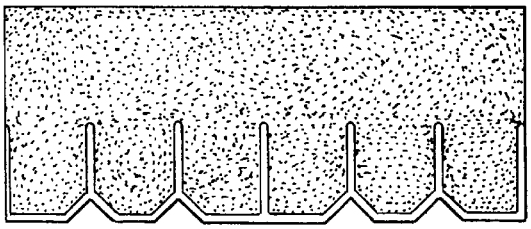
Figure 3D:
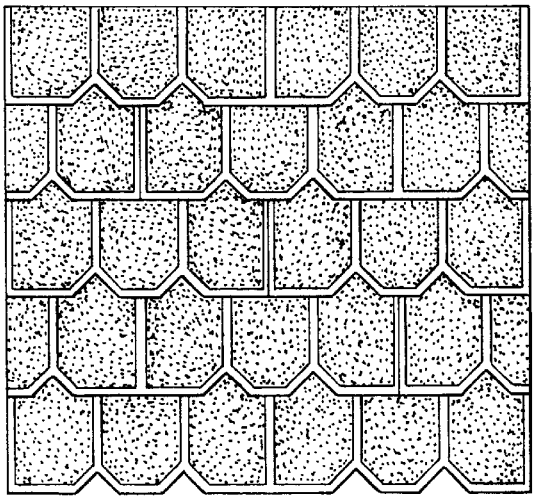

FIG. 3 is a top view of a plurality of shingles of 1C when installed in courses on a roof or siding surface.

Figure 4A:
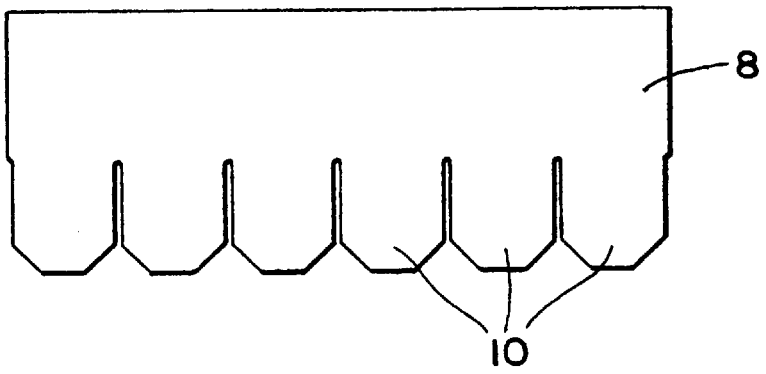
FIGS. 4A, 4B and 4C represent top plan views of the individual top sheet (4A) and backup strip (4B) and assembled shingle (4C), respectively for another embodiment of the invention. Similarly, FIGS. 5A, 5B and 5C; 6A, 6B and 6C; 7A, 7B and 7C; 8A, 8B and 8C and 9A, 9B and 9C are top plan views of the respective parts and assembled shingles of other embodiments of the present composite shingle.
Figure 4B:
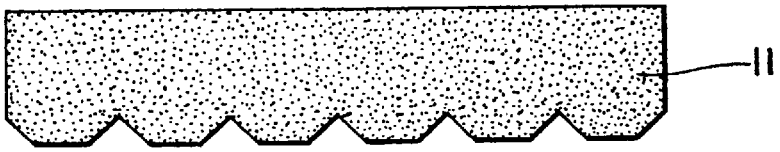
Figure 4C:
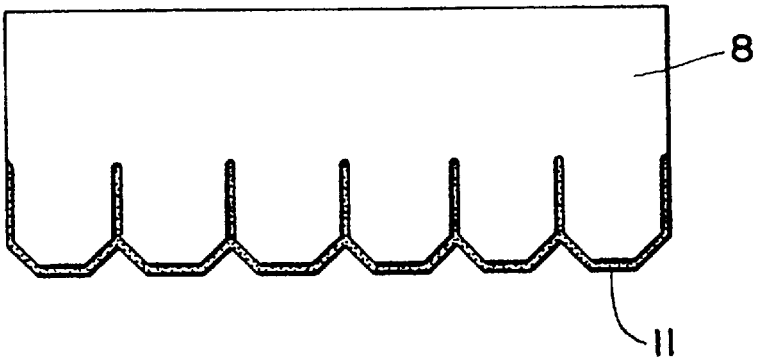

FIG. 4 represents a second embodiment of the invention wherein 4A shows shingle sheet 8 having tabs 10 of uniform size and shape with crimped tab corners. FIG. 4C is unattached backup strip 11 which is associated with shingle sheet 8 and is suitably mounted under tabs 10 as shown in the composite shingle of FIG. 4C.

Figure 5A:
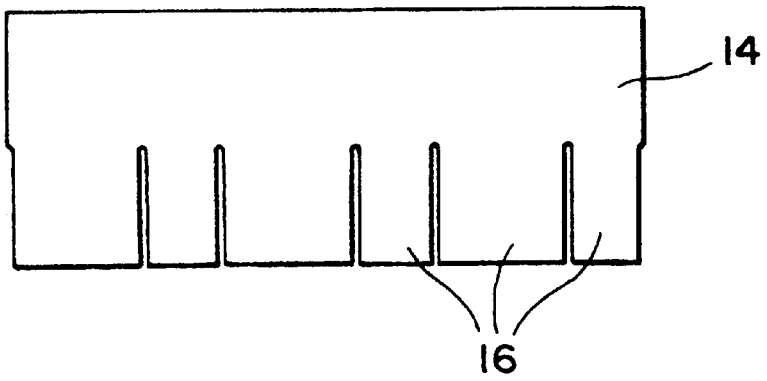
Figure 5B:
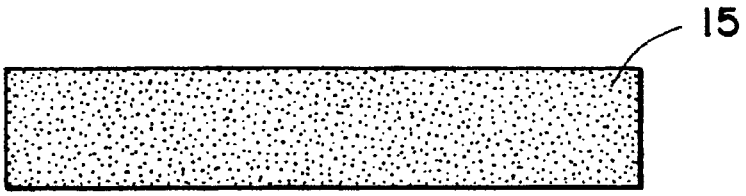
Figure 5C:
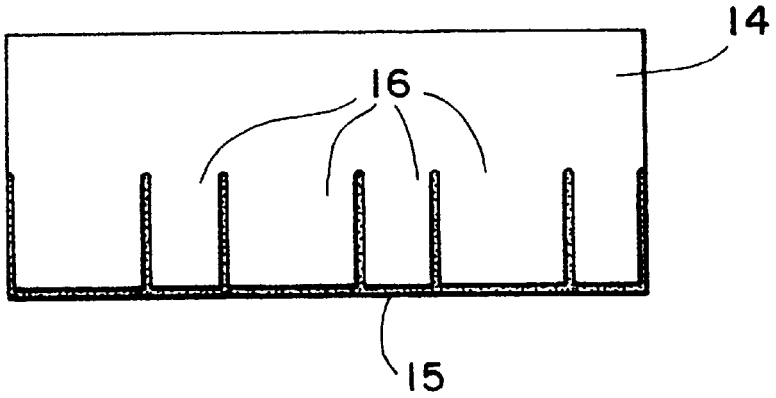

FIG. 5 illustrates a third embodiment of the present shingle wherein 5A shows shingle sheet 14 having rectangular tabs 16 of varying breadth. FIG. 5B shows backup strip 15 which is associated with sheet 14 and which is suitably mounted under tabs 16 as shown in FIG. 5C.

Figure 6A:
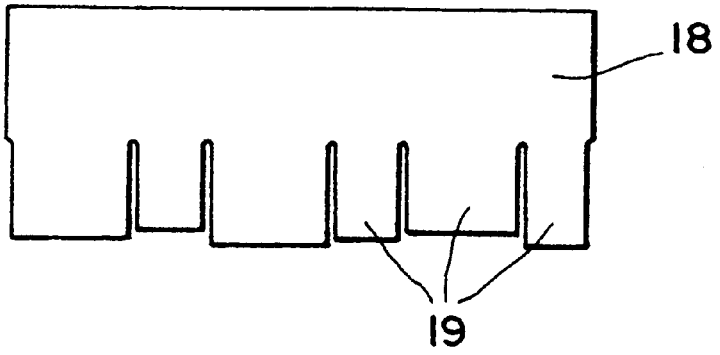
Figure 6B:
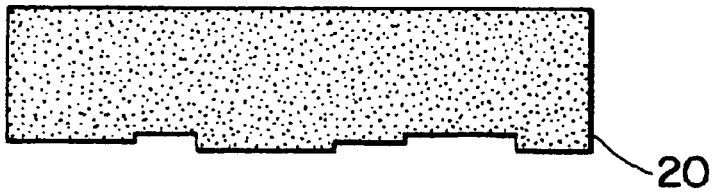
Figure 6C:
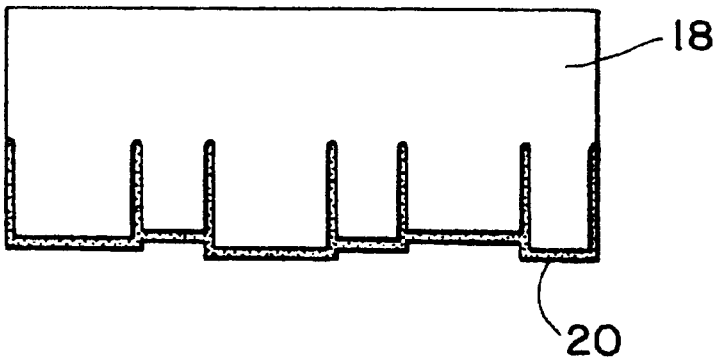

FIG. 6 shows a fourth embodiment wherein 6A is non-assembled shingle sheet 18 having rectangular and square tabs 19 of different extentions. FIG. 6B pictures detached backup strip 20 which is associated with sheet 18 and which is suitably mounted under tabs 19 as shown in the composite shingle of FIG. 6C.

Figure 7A:
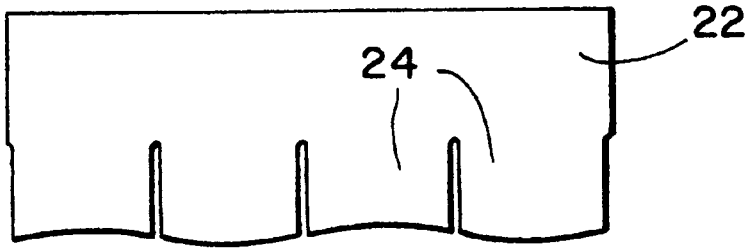
Figure 7B:
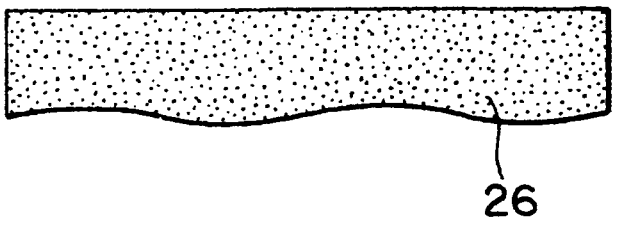
Figure 7C:
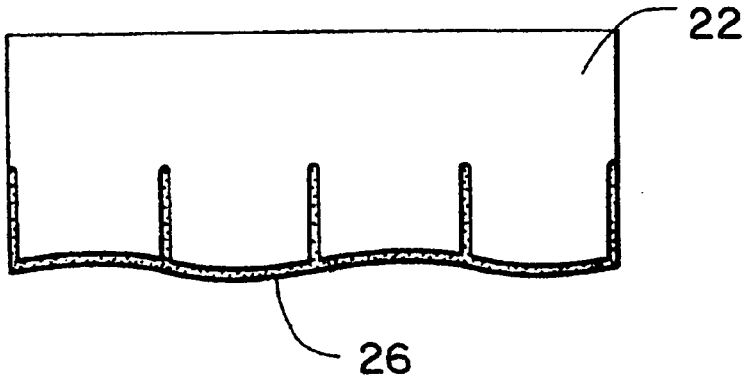

FIG. 7 illustrates a fifth embodiment wherein 7A is non-assembled shingle sheet 22 having tabs 24 defined with curved-bottom edges to provide a wavy appearance. FIG. 7B shows detached backup sheet 26 which is associated with sheet 22 and which is suitably mounted under tabs 24 as shown in FIG. 7C.

Figure 8A:
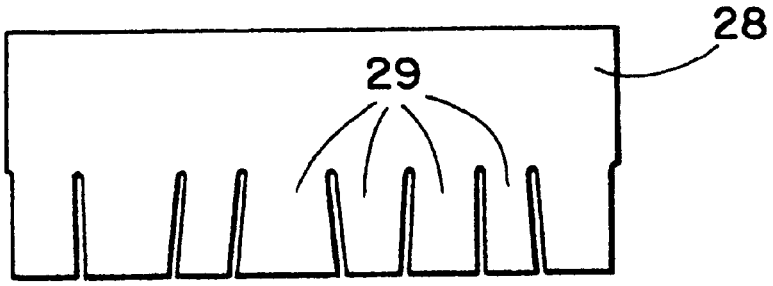
Figure 8B:
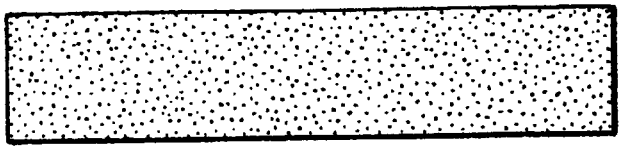
Figure 8C:
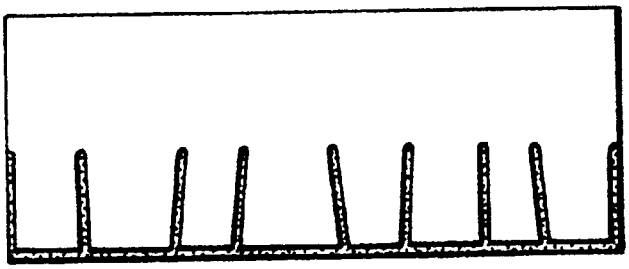

FIG. 8 shows another embodiment of the present composite shingle wherein 8A is non-assembled shingle sheet 28 having tabs 29 with acute and obtuse angle corners. FIG. 8B is detached backup strip 30 which is associated with sheet 28 and is suitably mounted under tabs 29 as shown in FIG. 8C.

Figure 9A:
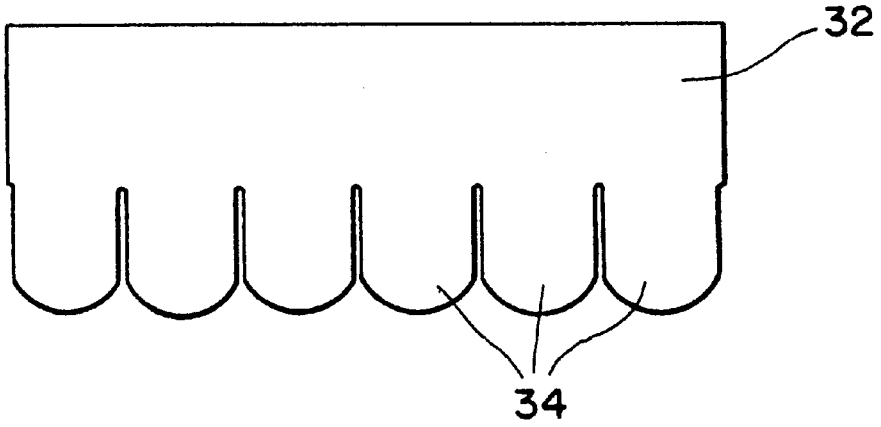
Figure 9B:
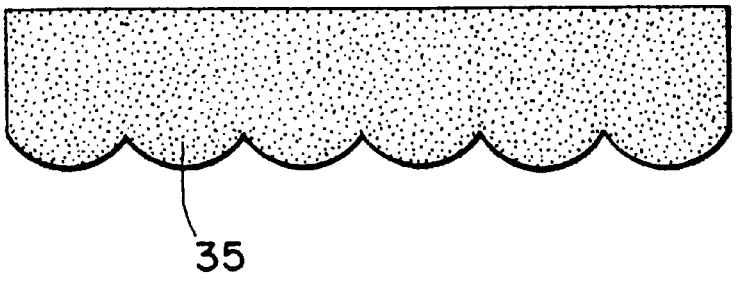
Figure 9C:
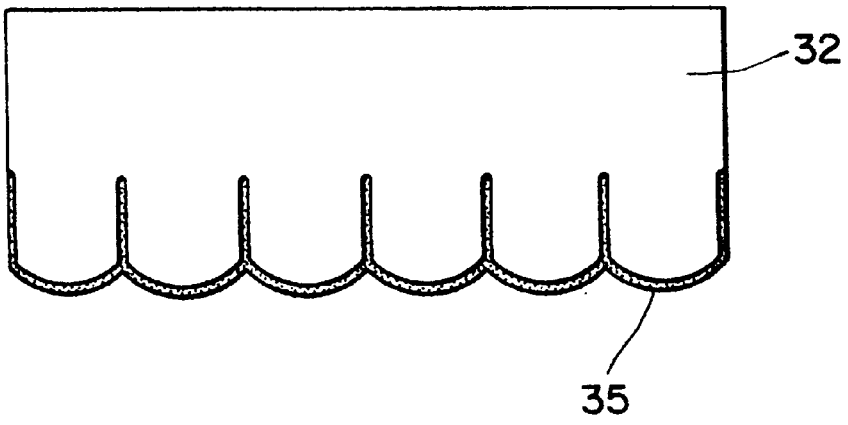

FIG. 9 illustrates yet another embodiment wherein 9A is non-assembled shingle sheet 32 having uniformly shaped tabs 33 with rounded edges. FIG. 9B shows backup strip 35 associated with sheet 32 which is suitably mounted under tabs 33 as shown in the composite shingle of FIG. 9C.

FIG. 10 is a side view of the composite shingles of FIGS. 1–5 and 7–9 wherein the tabs in the butt portion of the shingle sheet 40 is positioned over backup strip 42.

In all of the above figures the bottom boundary of the backup strip duplicates the contour of the tab ends and, upon installation, the backup strip forms a uniform distinguishable border around each tab so as to provide the present uniquely pleasing appearance.

Many other embodiments are within the scope of this invention and will become apparent from the foregoing disclosure.

What we claim is:

1. A composite shingle which includes (a) a shingle sheet having an upper undivided headlap portion and a lower butt portion divided into uniformly spaced tabs wherein the tabs at the leading and trailing edges of said butt portion are inset from the respective edges of the headlap by a distance of one half the space between the tabs and (b) a backup strip secured to the lower portion of the headlap, the leading and rear edges of said backup strip being coextensive with those of the headlap and the width being less than the width of the shingle sheet and greater than that of the butt portion, said strip being of a distinguishable hue or color with respect to said tabs and being positioned under said tabs and having a bottom edge which conforms in outline to the bottom edges of the tabs and extends below said tabs by a margin equal to the spaces between the tabs to form a uniform border of distinguishable hue or color around tabs of said shingle sheet.

2. The composite shingle of claim 1 wherein the shingle sheet is a rectangular sheet of between about 24 and about 48 inch length and between about 12 and about 17 inch width.

3. The composite shingle of claim 1 wherein the butt portion has 3 to 10 tabs and the tabs extend between about 4 and about 10 inches from said headlap.

4. The composite shingle of claim 3 wherein the tabs are of uniform size and shape.

5. The composite shingle of claim 1 wherein at least two tabs are of varied shape.

6. The composite shingle of claim 5 wherein the tabs are of equal height.

7. The composite shingle of claim 6 wherein at least two of the tabs have crimped corners.

8. The composite shingle of claim 6 wherein at least two of the tabs have rounded corners.

9. The composite shingle of claim 6 wherein at least two of the tabs have right angled corners.

10. The composite shingle of claim 6 wherein at least two of the tabs have curved lower edges.

11. The composite shingle of claim 6 wherein a pair of opposing tabs have facing right angled corners and opposite crimped or rounded corners.

12. The composite shingle of claim 11 wherein each tab has two opposing corners defining the bottom edge of the tab and wherein one pair of adjacent tabs has facing right angled corners and outer crimped or rounded corners.

13. The composite shingle of claim 12 wherein said pair of tabs is adjacent to tabs having crimped or rounded corners at both of their opposing sides.

14. The composite shingle of claim 5 wherein the tabs are of varied height.

15. The composite shingle of claim 1 wherein said strip extends below the lower end of each tab by a margin of from about 0.25 and about 1.25 inch.

16. The composite shingle of claim 1 wherein the top surface of the shingle sheet and the top surface of the strip are surface coated with weather resistant granules.

17. The composite shingle of claim 1 wherein the strip is of a distinguishably darker hue than that of the shingle sheet.

18. The composite shingle of claim 1 wherein the leading edge of the first tab is indented from the leading edge of the headlap by a distance ½ the space between successive tabs and the rear edge of the last tab is indented from the rear edge of the headlap by a distance of ½ the space between preceding tabs.

19. The composite shingle of any one of claims 1, 12 or 13 wherein the strip is of a distinguishably lighter hue or color than that of the shingle sheet.

* * * * *